US011199199B2

(12) United States Patent
Bazot et al.

(10) Patent No.: US 11,199,199 B2
(45) Date of Patent: Dec. 14, 2021

(54) INTERFACE MEMBER FOR RECONDITIONING A CONTROL RING OF AN ENGINE COMPRESSOR, AND ASSOCIATED RECONDITIONING METHOD

(71) Applicant: SAFRAN AIRCRAFT ENGINES, Paris (FR)

(72) Inventors: Olivier Bazot, Melun (FR); Jérémy Philippe Pierre Edynak, Viry-Chatillon (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 147 days.

(21) Appl. No.: 16/326,866

(22) PCT Filed: Aug. 22, 2017

(86) PCT No.: PCT/FR2017/052259
§ 371 (c)(1),
(2) Date: Feb. 20, 2019

(87) PCT Pub. No.: WO2018/037187
PCT Pub. Date: Mar. 1, 2018

(65) Prior Publication Data

US 2019/0195239 A1 Jun. 27, 2019

(30) Foreign Application Priority Data

Aug. 23, 2016 (FR) ..... 1657871

(51) Int. Cl.
*F04D 29/56* (2006.01)
*F04D 29/64* (2006.01)
*F01D 17/16* (2006.01)

(52) U.S. Cl.
CPC ..... *F04D 29/563* (2013.01); *F01D 17/16* (2013.01); *F01D 17/162* (2013.01);
(Continued)

(58) Field of Classification Search
CPC ..... F04D 29/54; F04D 29/56; F04D 29/563; F04D 29/564; F04D 29/644; F04D 29/44;
(Continued)

(56) References Cited

U.S. PATENT DOCUMENTS 3,966,276 A * 6/1976 Bellarbre ..... F16C 11/04 384/215
4,045,637 A * 8/1977 Mongeau ..... H01H 21/04 200/303

(Continued)

FOREIGN PATENT DOCUMENTS

EP 1 312 764 A2 5/2003
EP 1 439 308 A1 7/2004
RU 2 219 378 C1 12/2003

OTHER PUBLICATIONS

International Search Report as issued in International Patent Application No. PCT/FR2017/052259, dated Nov. 23, 2017.

*Primary Examiner* — David E Sosnowski
*Assistant Examiner* — Wayne A Lambert
(74) *Attorney, Agent, or Firm* — Pillsbury Winthrop Shaw Pittman LLP

(57) ABSTRACT

An interface member equips a control ring of a high-pressure compressor of an engine. This control ring has at least one housing intended to partially house a guide shoe. This interface member includes a central wall to which two holding tabs are secured, delimiting a through-housing having dimensions substantially identical to the initial dimensions of the housing, and suitable for being inserted into the housing, after it has been machined to receive same following a deformation, until the holding tabs keep it stationary relative to the control ring.

15 Claims, 3 Drawing Sheets

Figure 1:
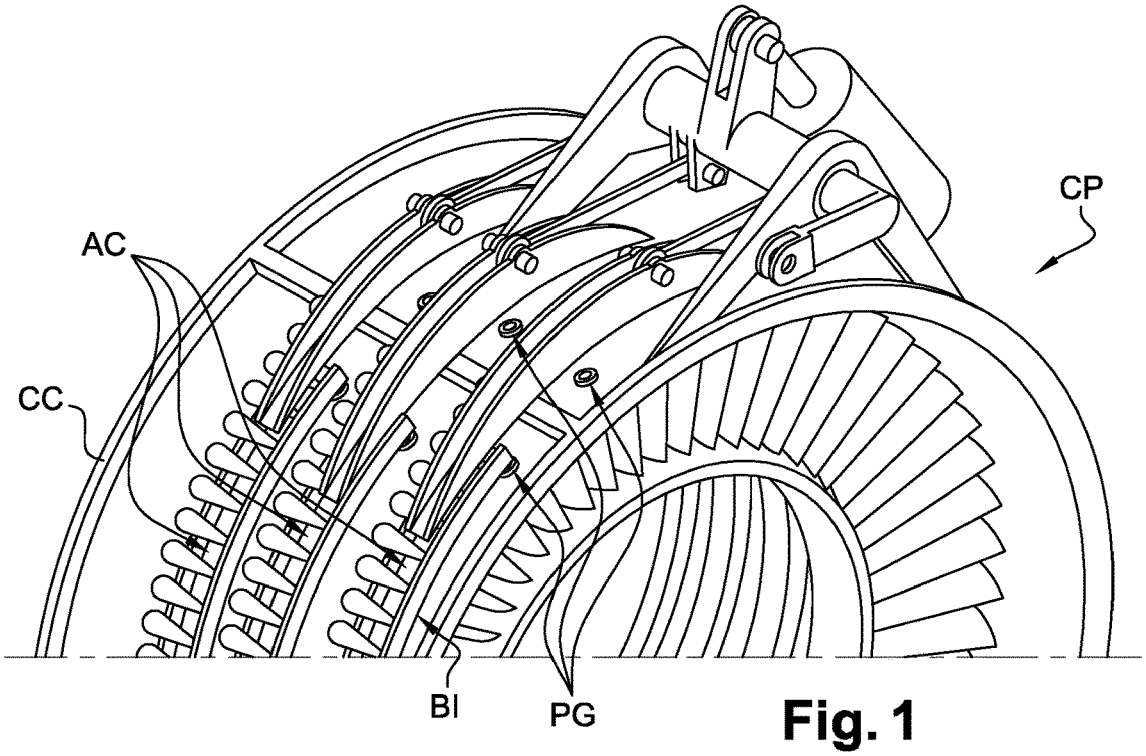

(52) U.S. Cl.
CPC ..... *F04D 29/644* (2013.01); *F05D 2230/80* (2013.01); *F05D 2240/128* (2013.01)

(58) Field of Classification Search
CPC .... F04D 29/441; F04D 29/442; F04D 29/444; F01D 17/148; F01D 17/16; F01D 17/162; F01D 17/165; F05D 2240/128; F05D 2230/10; F05D 2230/80; B23P 6/002; B23P 15/006; B23P 15/008; Y10T 29/4932
See application file for complete search history.

(56) References Cited

U.S. PATENT DOCUMENTS 4,498,790 A * 2/1985 Fisher ..... F01D 17/162 384/296
4,514,141 A * 4/1985 Marey ..... F01D 17/162 415/160
5,224,820 A * 7/1993 Brichet ..... F01D 17/162 415/150
5,271,588 A * 12/1993 Doyle ..... F16L 3/237 248/68.1
5,593,275 A * 1/1997 Venkatasubbu ..... F01D 17/162 415/160
6,086,327 A * 7/2000 Mack ..... F01D 17/162 384/273
6,682,299 B2 * 1/2004 Bowen ..... F01D 11/001 415/160
7,278,819 B2 * 10/2007 Schilling ..... F01D 17/162 415/147
7,360,990 B2 * 4/2008 Barbe ..... F01D 17/162 384/296
7,524,165 B2 * 4/2009 Bourgoin ..... F01D 17/162 415/160
7,588,416 B2 * 9/2009 Bouru ..... F01D 17/162 415/160
7,588,418 B2 * 9/2009 Maier ..... F01D 25/246 415/196
7,670,106 B2 * 3/2010 Bouru ..... F01D 17/162 415/160
7,722,318 B2 * 5/2010 Addis ..... F01D 17/162 415/148
7,805,944 B2 * 10/2010 Garry ..... F23R 3/06 60/752
9,316,113 B2 * 4/2016 Gervais ..... F01D 17/162
9,404,374 B2 * 8/2016 Addis ..... F04D 29/545
10,385,719 B2 * 8/2019 Maliniak ..... F01D 25/16
2007/0048126 A1 3/2007 Schilling
2014/0234098 A1 * 8/2014 Anderson ..... F01D 25/246 415/209.3
2018/0209444 A1 * 7/2018 Sebrecht ..... F01D 17/162
2020/0056494 A1 * 2/2020 Delahaye ..... F01D 17/162

* cited by examiner

INTERFACE MEMBER FOR RECONDITIONING A CONTROL RING OF AN ENGINE COMPRESSOR, AND ASSOCIATED RECONDITIONING METHOD

CROSS REFERENCE TO RELATED APPLICATIONS

This application is the U.S. National Stage of PCT/FR2017/052259, filed Aug. 22, 2017, which in turn claims priority to French Patent Application No. 1657871 filed Aug. 23, 2016, the entire contents of all applications are incorporated herein by reference in their entireties.

The invention relates to engines, in particular high power engines, and more precisely high pressure compressors which are part of such engines.

In some fields, as for example (and no limited to) that of aeronautics, engines comprising a high pressure compressor including variable stator vanes (VSV) which are controlled by control rings rotatably mounted about a case are used.

Each control ring is equipped with guide shoes which act, on the one hand, to ensure its concentricity about the case by adjusting the guide shoe/case clearance, and, on the other hand, to limit its deformation caused by the aerodynamic forces on the variable stator vanes which are exerted on kinematics upon use.

Each guide shoe is partially inserted in a corresponding housing of a control ring and is coupled to the same by a set screw. The latter comprises a first thread having an "inch" standard pitch which acts to secure its guide shoe to the control ring (in its housing) and which is rotatably stationary with respect to the control ring by a clamping nut, and a second thread having a metric thin pitch which is screwed in the guide shoe rotatably blocked in its housing.

During a set-up phase, the guide shoe slides in its housing by virtue of the presence of a clearance. But, in use, the presence of this clearance causes, under the effect of friction forces when the guide shoe is in contact with the case, a pressure at the guide shoe/control ring interface. In some cases, this pressure is high enough to generate a deformation (or a damage) of the housing of the control ring, in particular by a caulking effect.

In the presence of such a deformation (or damage), the control ring is considered as non-compliant during an inspection, and it is thus discarded and has to be replaced by a new control ring, which turns out to be expensive.

Moreover, this deformation generates an increase in the clearance between the housing and the guide shoe, which induces an increase in the flexion forces undergone by the set screw upon operating the engine, and thus can induce a plastic deformation, or even a break (in extreme cases, in particular of engine pumping), of this set screw.

In particular, one purpose of the invention is to avoid replacing control rings with deformed housing(s), by virtue of a reconditioning for restoring their links with the guide shoes.

To that end, it relies specially on a method for enabling a control ring of a high pressure compressor of an engine to be reconditioned, this control ring having at least one housing for partially housing a guide shoe and having undergone a deformation.

This method is characterised in that it comprises a step in which:

- the (each) deformed housing is machined such that it has dimensions adapted to house an interface part comprising holding tabs and a through housing having dimensions substantially identical to initial dimensions of the housing before deformation, and then
- the interface part is introduced in this machined housing until its holding tabs make it stationary with respect to the control ring.

Thus, a control ring can be reconditioned in order to be used again in a high pressure compressor after standard guide shoes have been housed in its (non-deformed) housings and the through housing(s) of its interface part(s) introduced in its machined housing(s).

For example, during the step of the method, the interface part can be introduced into the machined housing by press-in force inducing its deformation via a deformation slit it comprises.

The invention also provides an interface part for equipping a control ring of a high pressure compressor of an engine, this control ring having at least one housing for partially housing a guide shoe.

This interface part is characterised in that it comprises a central wall to which two holding tabs (also referred to hereinafter as "holding tongues") are secured, delimiting a through housing having dimensions substantially identical to initial dimensions of the housing, and able to be introduced into this housing, after it has been machined to accommodate it subsequently to a deformation, until its holding tabs make it stationary with respect to the control ring. Specifically, the interface part includes a lateral wall with integral holding tongues.

The interface part according to the invention can include further characteristics which can be taken separately or in combination, and in particular:

- its central wall can comprise a deformation slit able to enable it to be deformed during its introduction into the machined housing;
  - its deformation can be elastic;
- each holding tab can be flexible;
- each holding tab can be generally of an L shape so as to bear closely and partially against a side face of an edge of the control ring;
- alternatively, each holding tab can be generally of a U shape so as to surround a part of an edge of the control ring and to partially bear against a front face of this edge;
  - each holding tab can comprise one end having at least one curvature so as to bear against a central part of the control ring, located forwardly of the edge.

The invention also provides a control ring able to equip a high pressure compressor of an engine, and comprising at least one housing for partially housing a guide shoe and at least one interface part of the type set out above, partially introduced into this housing, after it has been machined to accommodate it subsequently to a deformation.

Figure 2A:
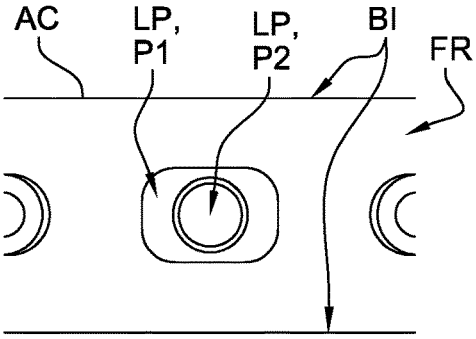
Figure 3A:
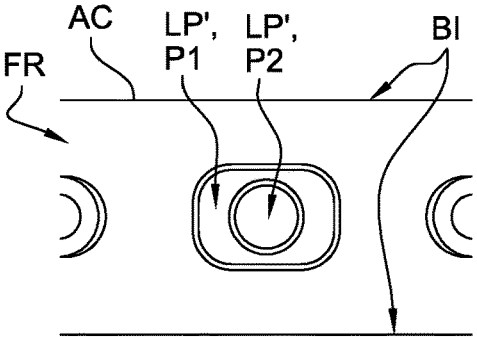
Figure 2B:
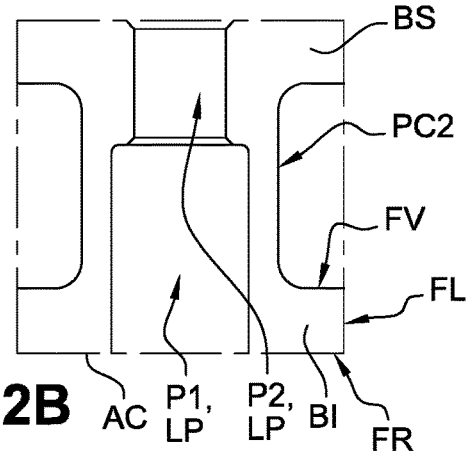
Figure 3B:
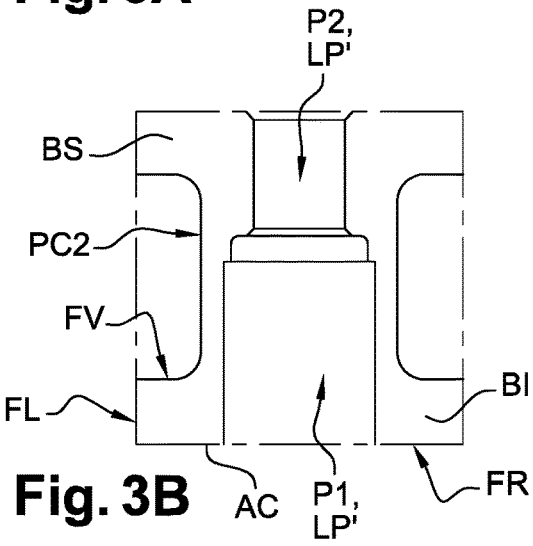
Figure 4:
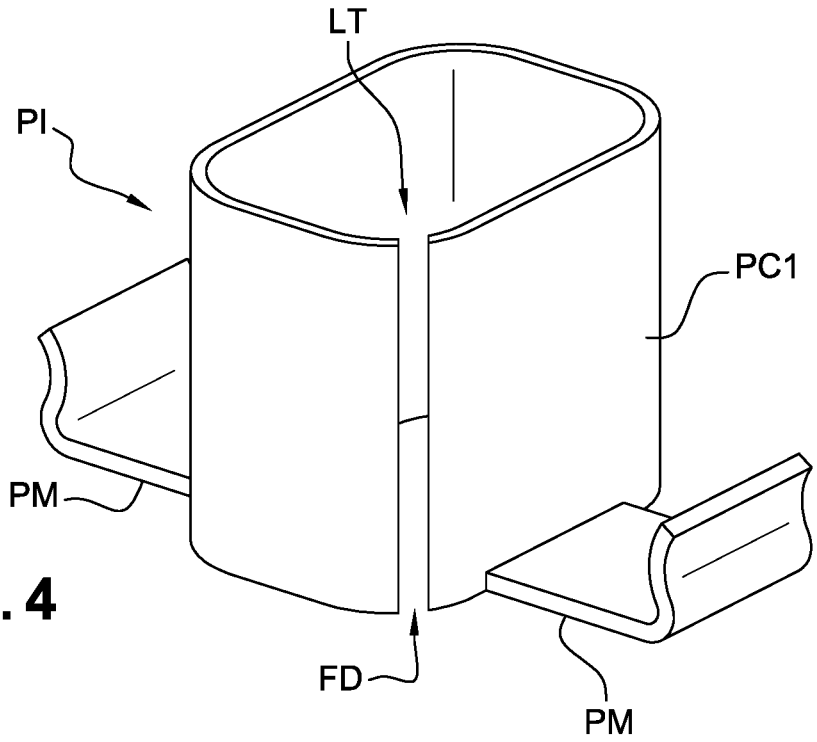
Figure 5:
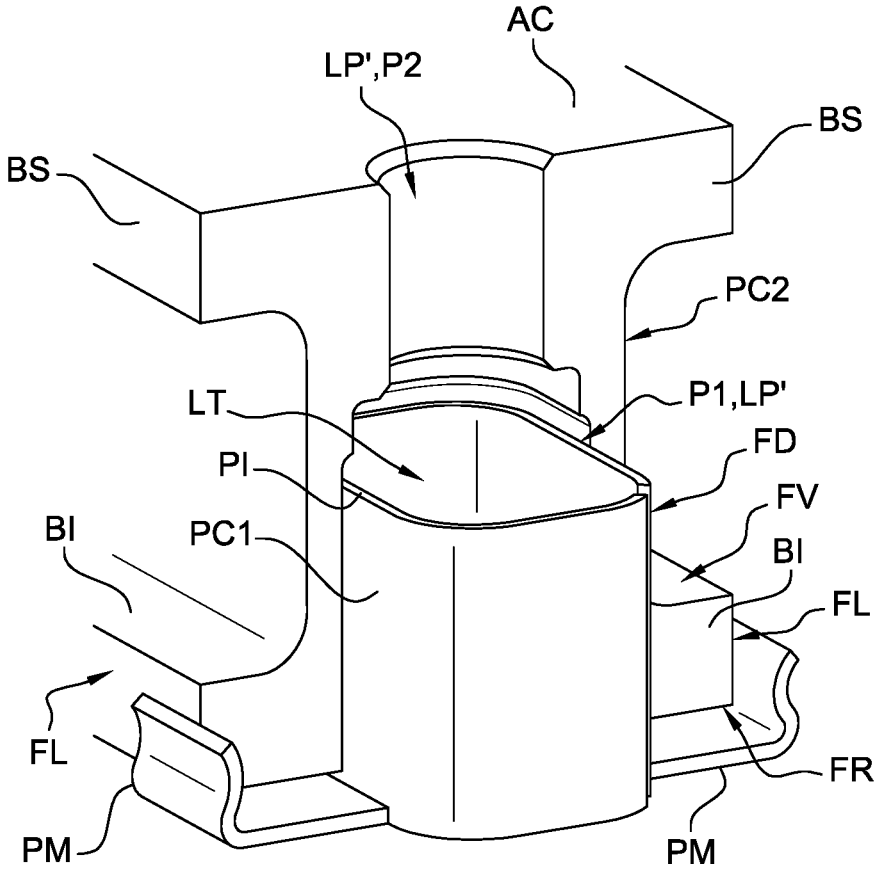
Figure 6:
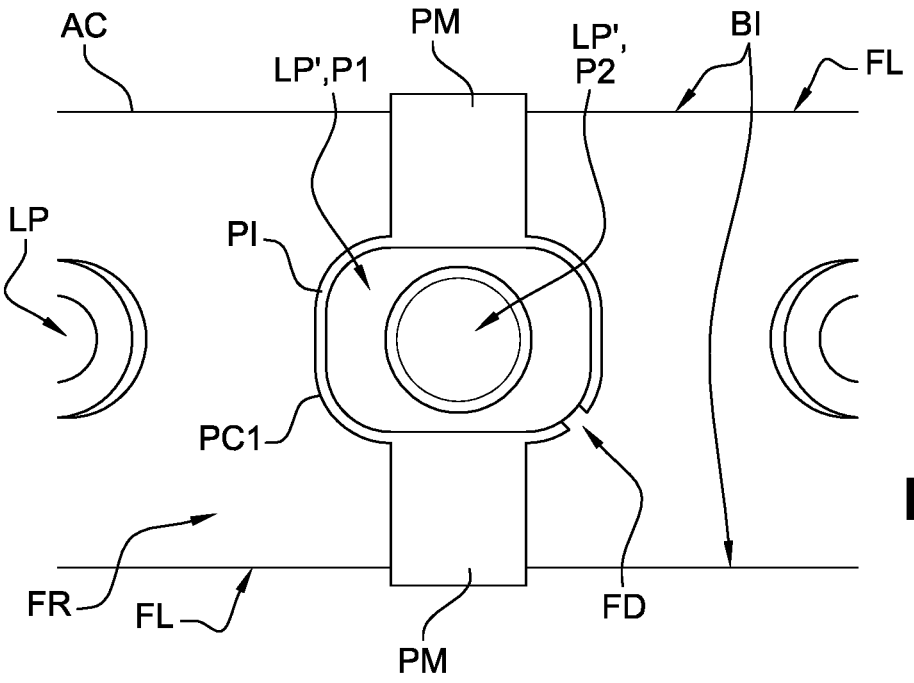
Figure 7:
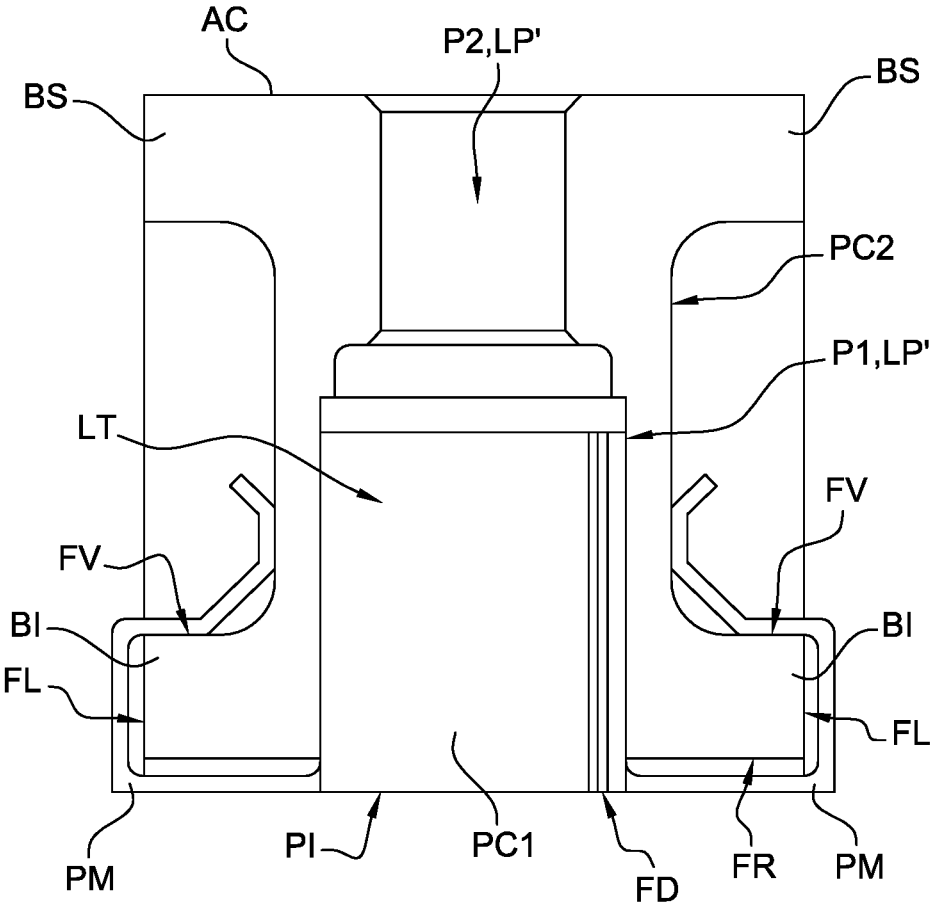

Further characteristics and advantages of the invention will appear upon examining the description detailed hereinafter, and the appended drawings (obtained by CAD ("Computer Aided Design/Computer Aided Drawing"), hence some lines and some grey levels seem discontinuous), in which:

FIG. 1 schematically illustrates, in a perspective view, a part of an example of a high pressure compressor of an engine, FIGS. 2A and 2B schematically illustrate, respectively in a bottom view and a cross-section view, a part of a control ring being part of a high pressure compressor of FIG. 1 and comprising a non-deformed housing of a guide shoe, FIGS. 3A and 3B schematically illustrate, respectively, in a bottom view and a cross-section view, a part of the control ring of FIGS. 2A and 2B, after machining a deformed housing and before introducing an interface part according to the invention, FIG. 4 schematically illustrates, in a perspective and partially cross-section view, a first exemplary embodiment of an interface part according to the invention, FIG. 5 schematically illustrates, in a perspective and partially cross-section view, the interface part of FIG. 4 after it has been introduced in the machined housing of the control ring of FIGS. 3A and 3B, FIG. 6 schematically illustrates, in a bottom view, the interface part of FIG. 4 after it has been introduced in the machined housing of the control ring of FIGS. 3A and 3B, and FIG. 7 schematically illustrates, in a cross-section view, a second exemplary embodiment of an interface part after it has been introduced in the machined housing of the control ring of FIGS. 3A and 3B.

In particular, one purpose of the invention is to provide an interface part PI for equipping a control ring AC able to equip a high pressure compressor CP of an engine and comprising at least one deformed housing, and a reconditioning method therefor.

In what follows, it is considered, by way of non-limiting example, that the high pressure compressor CP is for equipping a high power engine of an airplane, for example of GE90-Base or GE90-115 or GP7200 type. But the invention is not limited to this engine type. Indeed, it relates to any engine comprising a high pressure compressor including variable stator vanes (VSV) controlled by control rings rotatably mounted about a case.

In FIG. 1, a part of an example of a high pressure compressor CP of an engine is schematically illustrated. This high pressure compressor CP comprises in particular a case CC on which control rings AC controlling variable stator vanes are rotatably mounted.

Each control ring AC comprises several housings LP (one of which (not deformed) is illustrated in FIGS. 2A and 2B) each partially housing a guide shoe PG. Each housing LP extends along a direction of a thickness of the control ring AC, as shown in FIG. 2B, which represents the cross-section view of the control ring AC. The guide shoes PG ensure concentricity of the control ring AC about a case CC (by adjusting the guide shoe/case clearance), and limit the deformation of the control ring AC which is caused by the aerodynamic forces on the variable stator vanes.

Actually, and as illustrated in FIGS. 2A and 2B, each housing LP comprises a first ("lower") part P1 in which a part of the corresponding guide shoe PG is inserted, and a second ("higher") part P2 which communicates with the first part P1 and with the outside and which enables a set screw ensuring coupling of the guide shoe PG to the control ring AC to pass therethrough.

Each set screw more precisely comprises a first thread having an "inch" standard pitch which acts to secure its guide shoe PG to the control ring AC and which is rotatably stationary relative to this control ring AC by a clamping nut, and a second thread having a metric thin pitch which is screwed in the guide shoe PG rotatably blocked in its housing LP.

When the pressure at the guide shoe PG/control ring AC interface is significant, a deformation (or damage) of the first part P1 of the housing LP in which a part of the guide shoe PG is inserted can occur.

The invention is for enabling reconditioning of a control ring AC having at least one housing LP that underwent a deformation. This reconditioning is made by implementing a reconditioning method according to the invention.

A reconditioning method according to the invention comprises a step in which first the deformed housing of a control ring AC is machined such that it has dimensions adapted to house an interface part (or "foil") PI comprising holding tabs PM and a through housing LT having dimensions substantially identical to initial dimensions that this housing had before being deformed (and thus when it consisted of a non-deformed housing LP).

It will be understood that the initial dimensions of the first part P1 of a (non-deformed) housing LP are herein concerned (and not those the first part P1 of the deformed housing has). The purpose of the machining is indeed to transform the first part P1 of the deformed housing such that it can house an interface part PI the through housing LT of which is for replacing "identically" the first part P1 that the housing LP initially included before being deformed.

In what follows, a deformed housing that has been machined according to the invention is referenced LP'. The result of such a machining is in particular observable in FIGS. 3A and 3B.

A first non-limiting exemplary embodiment, of an interface part (or foil) PI according to the invention is illustrated in FIG. 4. As illustrated, the interface part PI comprises a central wall PC1 to which two holding tabs or holding tongues PM, delimiting a through housing LT having dimensions substantially identical to initial dimensions of a housing LP, and able to be introduced in a machined housing LP', are secured. As shown in FIG. 4, the holding tongues are integral with the lateral wall of the interface part PI.

Once the machining of the (each) deformed housing is made, the step of the method is continued by introducing an interface part PI into the machined housing LP' until its holding tabs PM make it stationary relative to the control ring AC. The final position of the interface part PI in the machined housing LP' of a control ring AC is illustrated in FIGS. 5 and 6.

Once the control ring AC is reconditioned, by machining and coupling interface part(s) PI, it can be used again in a high pressure compressor CP after standard guide shoes PG have been housed in its housings LP (not deformed) and the through housing(s) LT of its interface part(s) PI introduced in its machined housing(s) LP'.

Preferably, in the step of the method, the interface part PI is introduced into the machined housing LP' by press-in force inducing its deformation via a deformation slit FD it comprises (see FIG. 4). This deformation slit FD is, preferably and as illustrated in FIGS. 4 to 6, substantially linear and parallel to the direction of introduction of the interface part PI into the corresponding machined housing LP'. Moreover, it extends preferably on the entire height of the central wall PC1.

It will be understood that thanks to this deformation slit FD, it is possible to slightly reduce the transverse cross-section of the interface part PI in order to facilitate its introduction into the corresponding machined housing LP'.

Preferably, the deformation of the interface part PI is elastic. That enables indeed that it resumes, after being introduced, substantially the shape it had before being introduced, and thus that its central wall PC1 contacts the inner face of the machined housing LP'.

To allow this elasticity while being very resisting, the interface part PI can, for example, be made of a metal material, such as for example Inco 718. In this case, it can be made from a shaped metal sheet. But it could also be made by moulding in a plastic or synthetic material, such as for example Vespel.

Also preferably, each holding tab PM of the interface part PI is flexible. Indeed, that facilitates positioning of the interface part PI in its final position and enhances the stationary condition of the same (PI) with respect to the control ring AC.

On the other hand, the holding tabs PM can have different shapes. Two of them are respectively illustrated in FIGS. 4 to 6 and 7.

In the first exemplary embodiment illustrated in FIGS. 4 to 6, each holding tab PM is generally of an L shape so as to closely and partially bear against a side face FL of an edge BI of the control ring AC. In this example, the control ring AC has an I-shaped (or H-shaped rotated by 90°) cross-section. Consequently, it comprises a "lower" part comprising two lower edges BI, an "upper" part comprising two upper edges BS, and a central part PC2 connecting its lower and upper parts. Each lower edge BI comprises a rear face FR, a front face FV, opposite to the rear face FR, and a side face FL connecting its rear FR and front FV faces. Here, each holding tab PM thus surrounds a part of the rear face FR and a part of the side bearing FL of one of both lower edges BI, and bears against this side face FL. In order to promote this side rest, the part of the holding tab PM which is placed in front of the side face FL can have at least one curvature, as illustrated in FIGS. 4 to 6.

This first exemplary embodiment is advantageous because it enables the side face FL to bear independently of its height. In other words, it enables a same interface part PI to be used on control rings AC the lower edges BI of which have different thicknesses.

In the second exemplary embodiment illustrated in FIG. 7, each holding tab PM is generally of a U shape so as to surround a part of the lower edge BI of the control ring AC (that is the rear FR, side FL and front FV faces) and to partially bear against the front face FV of this lower edge BI. This second exemplary embodiment enables the interface part PI to be lockingly stationary relative to the control ring AC. However, it makes the positioning of the interface part PI in its final position with respect to the control ring AC less easy.

It will be noted, as illustrated in a non-limiting way in FIG. 7, that in this second exemplary embodiment, each holding tab PM can comprise an end (placed in front of the front face FV and the central part PC2) which has at least one curvature so as to bear against this central part PC2 of the control ring AC (located forwardly of the lower edge BI). That makes it possible to promote bearing of the holding tab PM against the central part PC2 of the control ring AC.

It will be also noted that a coating can be placed at least on the faces of the interface part PI which are in contact with the inner face of the corresponding machined housing LP', so as to limit wear. For example, this coating can be a varnish.

The invention is not limited to the embodiments of the interface part and reconditioning method described above, only by way of example, but it encompasses all the alternatives that those skilled in the art could contemplate within the scope of the claims hereinafter only.

The invention claimed is:

1. A method for reconditioning a control ring of a high pressure compressor of an engine, said control ring having at least one housing extending along a direction of a thickness of the control ring for partially housing a guide shoe and said housing having undergone a deformation, the method comprising:

machining said housing, that has undergone deformation, such that the housing has dimensions adapted to house an interface part comprising a lateral wall with integral holding tongues and a through housing, wherein the through housing has dimensions identical to initial dimensions of said housing before said deformation; and then introducing said interface part into said machined housing until the integral holding tongues make the interface part stationary relative to said control ring, wherein the integral holding tongues are dimensioned such that each integral holding tongue extends from an end section of the lateral wall and bear against an outer side face and along only a portion of the thickness of the control ring when the interface part is introduced into the machined housing, and wherein each integral holding tongue is flexible.

2. The method according to claim 1, wherein said interface part is introduced into said machined housing by press-in force inducing deformation via a deformation slit, and wherein the interface part comprises the deformation slit.

3. The method according to claim 1, wherein the integral holding tongues are provided at a bottom portion of the lateral wall and extend away from the lateral wall such that the integral holding tongues extend outside the housing when the lateral wall is introduced into the machined housing.

4. The method according to claim 3, wherein each of the integral holding tongues extends perpendicularly to a longitudinal axis of the interface part.

5. The method according to claim 3, wherein each of the integral holding tongues are provided in contact with an external surface of the control ring when the lateral wall is introduced into the machined housing.

6. An interface part for a control ring of a high pressure compressor of an engine, said control ring having at least one housing extending along a direction of a thickness of the control ring for partially housing a guide shoe, the interface part comprising:

a lateral wall with integral holding tongues delimiting, longitudinally, a through housing having dimensions identical to initial dimensions of said at least one housing that has undergone a deformation, and said lateral wall introduced in said at least one housing, after said at least one housing is machined to accommodate the through housing subsequent to the deformation of said at least one housing, until said integral holding tongues make the interface part stationary relative to said control ring, wherein the integral holding tongues are dimensioned such that each integral holding tongue extends from an end section of the lateral wall and bear against an outer side face and along only a portion of the thickness of the control ring when the interface part is introduced into the machined housing, and wherein each integral holding tongue is flexible.

7. The interface part according to claim 6, wherein said lateral wall comprises a deformation slit enabling the interface part to be deformed during the introduction of said interface part in said machined housing.

8. The interface part according to claim 7, wherein said deformation slit is elastic.

9. The interface part according to claim 6, wherein each holding tongue is generally of an L shape so as to bear closely and partially against the outer side face of an edge of said control ring.

10. The interface part according to claim 6, wherein each holding tongue is generally of a U shape so as to surround a part of an edge of said control ring and to bear partially against a front face of said edge.

11. The interface part according to claim 10, wherein each holding tongue comprises an end having at least one curvature so as to bear against a central part of said control ring, located forwardly of said edge.

12. The interface part according to claim 6, wherein the integral holding tongues are provided at a bottom portion of the lateral wall and extend away from the lateral wall such that the integral holding tongues extend outside the housing when the lateral wall is introduced into the machined housing.

13. The interface part according to claim 12, wherein each of the integral holding tongues extends perpendicularly to a longitudinal axis of the interface part.

14. The interface part according to claim 12, wherein each of the integral holding tongues is provided in contact with an external surface of the control ring when the lateral wall is introduced into the machined housing.

15. A control ring of a high pressure compressor of an engine, the control ring comprising:

a housing for partially housing a guide shoe, said housing extending along a direction of a thickness of the control ring, and an interface part comprising a lateral wall with integral holding tongues, said interface part delimiting, longitudinally, a through housing having dimensions identical to initial dimensions of said housing that has undergone a deformation, said interface part being partially introduced in said housing, after said housing is machined to accommodate the through housing subsequent to the deformation of said housing, until said holding tongues make the interface part stationary relative to said control ring, wherein the integral holding tongues are dimensioned such that each integral holding tongue extends from an end section of the lateral wall and bear against an outer side face and along only a portion of the thickness of the control ring when the interface part is introduced into the machined housing, and wherein each integral holding tongue is flexible.

* * * * *